US005810175A

United States Patent [19]

Williamson

[11] Patent Number: 5,810,175

[45] Date of Patent: Sep. 22, 1998

[54] ADJUSTABLE SIZE SORTING APPARATUS FOR ROUND PRODUCE

[76] Inventor: Robert L. Williamson, 67602 62nd St., Hartford, Mich. 49057

[21] Appl. No.: 940,490

[22] Filed: Sep. 30, 1997

[51] Int. Cl.[6] ..... B07B 13/05

[52] U.S. Cl. ..... 209/665; 209/668; 209/379

[58] Field of Search ..... 209/665, 674, 209/660, 379, 385, 389, 676, 679, 668

[56] References Cited

U.S. PATENT DOCUMENTS 3,347,368 10/1967 Mogensen ..... 209/674
3,713,537 1/1973 Walker ..... 209/665

FOREIGN PATENT DOCUMENTS 1965243 8/1971 Germany ..... 209/668

*Primary Examiner*—David H. Bollinger
*Assistant Examiner*—Joe Dillon, Jr.
*Attorney, Agent, or Firm*—R. Tracy Crump

[57] ABSTRACT

An apparatus for sorting round produce by diameter size using a conventional transport conveyer assembly and including a sorting size adjustment mechanism to automatically adjust the produce sorting size and an anti-pinch mechanism to prevent damaging the produce during the sorting process is disclosed. The conveyer assembly has a horizontal top run and a V-shaped bottom return run formed by a plurality of elastic conveyer bands trained about three elongated roller shafts. The conveyer bands are spaced across the width of the roller shafts at a fixed horizontal distance. As the produce is transported across the top conveyer run, the produce, whose diameter is smaller than the spacing between the adjacent conveyer bands, falls between adjacent conveyer bands for collection and the remaining produce travels to the end of the top conveyer run for separate collection. The sorting size adjustment mechanism used by the sorting apparatus of this invention allows the spacing between adjacent conveyer bands to be varied without altering the horizontal spacing of the conveyer bands. The size adjustment mechanism raises and lowers alternate conveyer bands over the sorting portion of the top conveyer run. Raising and lowering alternate conveyer bands increases and decreases the spacing between adjacent conveyer bands diagonally without changing the horizontal distance between the conveyer bands. The anti-pinch mechanism includes a second set of parallel elastic bands trained about the conveyer bands drive roller shaft and a pinch roller shaft between the conveyer bands. The anti-pinch bands prevent produce from being pinched between adjacent conveyer bands.

9 Claims, 6 Drawing Sheets

ADJUSTABLE SIZE SORTING APPARATUS FOR ROUND PRODUCE

This invention relates to a conveyer driven apparatus for sorting round produce, such as blueberries and small tomatoes by diameter size, and in particular a conveyer driven size sorting apparatus that can adjust sorting size by changing the relative spacing between adjacent conveyer bands.

BACKGROUND OF THE INVENTION

In the produce industry, different grades of round produce are often determined by the diameter size of the produce. The time and labor intensive task of manually sorting and packaging small round produce, such as blueberries, cherries, cherry tomatoes, and radishes has lead to the development of automated conveyer driven size sorting apparatus. Size sorting apparatus are often used in combination with other conveyer driven apparatus that clean and package the produce as part of an automated processing system.

Conventional conveyer driven size sorting apparatus use a plurality of elastic conveyer bands trained about two or more conveyer rollers to form a horizontal top conveyer run upon which the produce travels. The conveyer bands are seated within annular grooves formed across the length of the rollers, which space the bands at equal horizontal distances. The horizontal spacing between adjacent conveyer bands provides the sizing function. Produce whose diameter is smaller than the horizontal spacing between adjacent conveyer bands falls between the bands of the top conveyer run for collection in a hopper or on another conveyer, while the remaining produce whose diameter is larger than the spacing between the adjacent bands is transported to the end of the top conveyer run.

Heretofore, adjusting the sorting size for a conveyer driven size sorting apparatus required disassembling the apparatus. Changing the sorting size of conventional conveyer driven size sorting apparatus meant changing the horizontal spacing between the conveyer bands. Since the horizontal spacing between the conveyer bands is determined by the spacing of the annular grooves formed in the conveyer rollers, changing the horizontal spacing between the bands required installation of different conveyer rollers, which required disassembling the apparatus.

Significant time is lost in disassembling and installing new conveyer rollers for each adjustment to the sorting size. If the conveyer rollers are not selected properly to obtain the desired sorting size, the apparatus must be disassembled again. In addition, because the sorting size was dependent on the horizontal spacing of the grooves formed in the conveyer rollers, minute adjustments to the sorting size were not possible. The inconvenience of the manual disassembly of the size sorting conveyers to alter sort sizes, significantly diminishes the effectiveness of an automated produce packaging system.

SUMMARY OF THE INVENTION

The adjustable size sorting apparatus of this invention eliminates the need to manually disassemble the apparatus every time the sorting size is changed. The sorting size can be adjusted between its minimum and maximum sorting size settings by simply turning a turnbuckle. In addition, the apparatus of this invention allows the sorting size to be adjusted while the apparatus is operating. Because the sorting apparatus does not require disassembly to change sorting sizes, the maintenance and operation of the apparatus is simpler and more efficient than conventional conveyer driven sorting apparatus, particularly for small growers and packagers.

The adjustable sorting apparatus of this invention uses a conventional transport conveyer assembly supported by a table-like frame, and includes a sorting size adjustment mechanism for adjusting the sorting size and an anti-pinch mechanism to prevent damaging the produce during the sorting process. The conveyer assembly has a horizontal top run and a V-shaped bottom return run formed by a plurality of elastic conveyer bands trained about three elongated rollers. The conveyer bands are propelled about the three rollers by an electric motor, which is operatively connected to one of the rollers as a drive roller. The conveyer bands are seated in annular grooves spaced across the length of the conveyer rollers at fixed horizontal distances. Produce is deposited onto the top run of the conveyer assembly and propelled along the length of the top conveyer run. As the produce is propelled over the sorting portion of the top conveyer run, produce, whose diameter is smaller than the spacing between the adjacent conveyer bands, falls through the top conveyer run and is collected in a hopper. The remaining produce travels to the end of the top conveyer run, where it falls into a second hopper or is deposited on another conveyer or sorting apparatus for further sorting. The sorting size adjustment mechanism used by the sorting apparatus of this invention allows the spacing between adjacent conveyer bands to be varied without altering the horizontal spacing of the conveyer bands. The size adjustment mechanism includes two pulley shafts each mounted between a pair of articulated swing arms. Each pulley shaft carries a plurality of pulleys, which are spaced to engage alternate conveyer bands. The swing arms allow the pulley shaft to move up and down to lift alternate conveyer bands. Two lever arms and a turnbuckle connect each pair of swing arms to allow complementary movement of the pulley shafts. Contracting and expanding the turnbuckle pulls and pushes the lever arms inward to raise and lower the pulley shafts and adjust the height of alternate conveyer bands. At the minimum sorting size setting between adjacent conveyer bands, all of the bands are positioned at the same height and the spacing between adjacent conveyer bands is equal to the fixed horizontal distance between the bands. The sorting size is increased by raising alternate conveyer bands. Raising alternate conveyer bands increases the spacing between adjacent conveyer bands diagonally, while the horizontal spacing of the conveyer bands remains fixed.

The anti-pinch mechanism includes a second set of parallel elastic bands trained about the drive roller and a pinch roller, which prevents produce from being pinched between adjacent conveyer bands. The anti-pinch area of the top conveyer run is immediately adjacent to the sorting area so that produce passes from the sorting area directly onto the anti-pinch area. Since the spacing between adjacent conveyer bands decreases once the produce passes the second roller shaft, produce can be pinched between the bands. As produces moves past the rear pulley shaft and the spacing between adjacent conveyer bands begin to decrease, the produce carried between adjacent conveyer bands is pushed upward by the anti-pinch bands. Over the rear portion of the top conveyer run, the produce rides on adjacent conveyer bands and anti-pinch bands. The horizontal spacing between adjacent conveyer and anti-pinch bands is relatively insignificant and therefore produce rides atop to the end of the apparatus without being damaged by the converging conveyer bands.

Accordingly, an advantage of this invention is that the sorting size for the produce can be changed by turning a turnbuckle.

Another advantage of this invention is that the size sorting apparatus does not require disassembly in order to change sorting size for the produce.

Another advantage of this invention is that because the size sorting apparatus does not require disassembly to change sort sizes, the apparatus is simple to maintain and operate.

Another advantage of this invention is that the size sorting apparatus protects the produce from damage caused by being pinched between conveyer bands during the size sorting process.

Another advantage of this invention is that the sorting size can be adjusted while the size sorting apparatus is operating.

Other advantages will become apparent upon a reading of the following description.

BRIEF DESCRIPTION OF THE DRAWINGS

A preferred embodiment of the invention has been depicted for illustrative purposes only wherein.

DESCRIPTION OF THE PREFERRED EMBODIMENT

The preferred embodiment herein described is not intended to be exhaustive or to limit the invention to the precise form disclosed. It is chosen and described to best explain the invention so that others skilled in the art might utilize its teachings.

FIGS. 1–4 show the adjustable size sorting apparatus 10 of this invention. Sorting apparatus 10 is designed to be used as a stand alone size sorting unit or as a component unit in an automated conveyer driven packaging system for small round produce, such as blueberries, cherries, cherry tomatoes, radishes and similar produce. The physical dimensions and configuration of the sorting apparatus can vary to accommodate its application in an automated packaging system or as a stand alone unit for size sorting various types of round produce without changing the scope of the invention.

Figure 1:
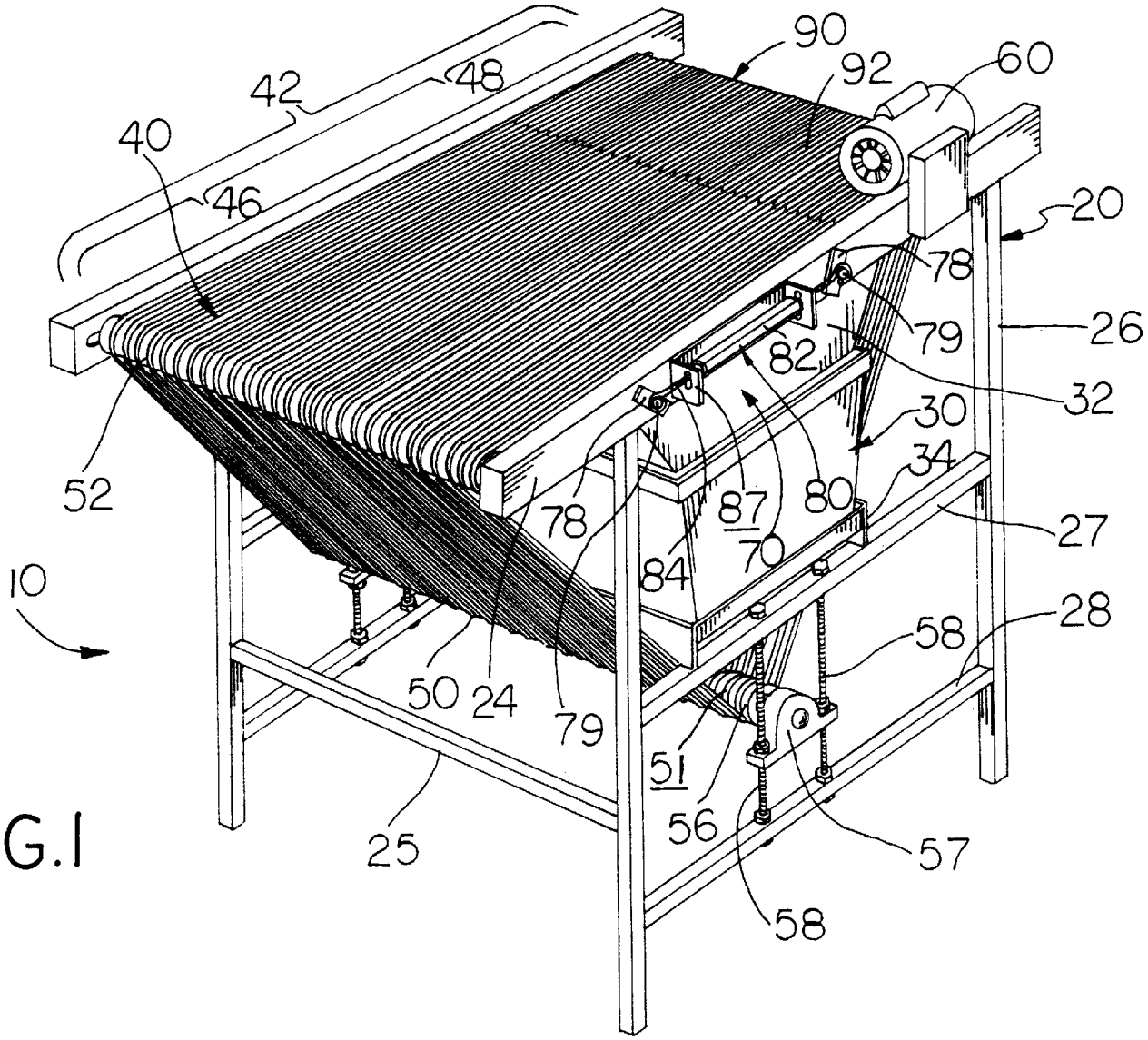
FIG. 1 is a perspective view of the adjustable size sorting apparatus of this invention.
Figure 2:
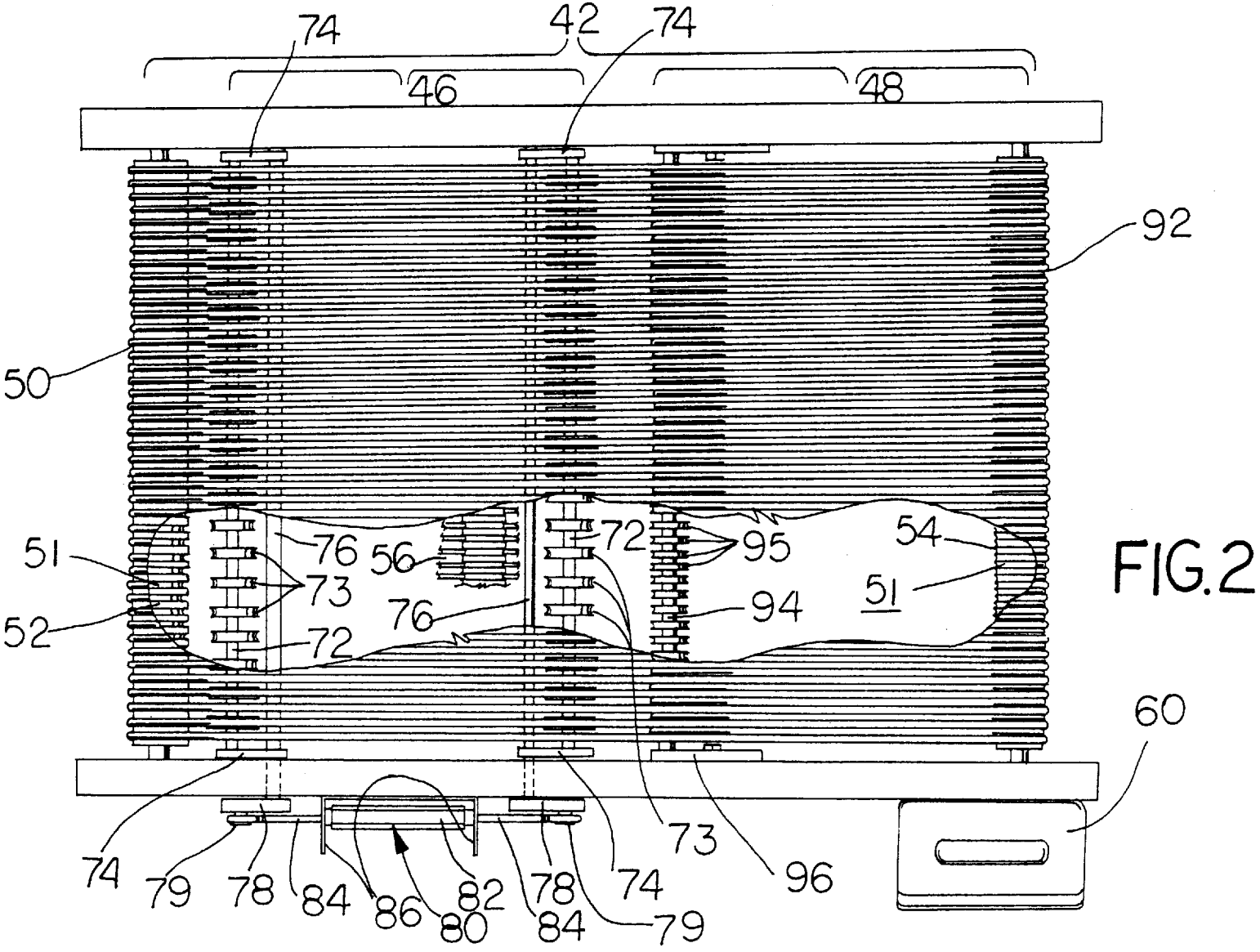
FIG. 2 is a top view of the sorting apparatus of this invention showing portions of the conveyer bands cutaway.
Figure 3:
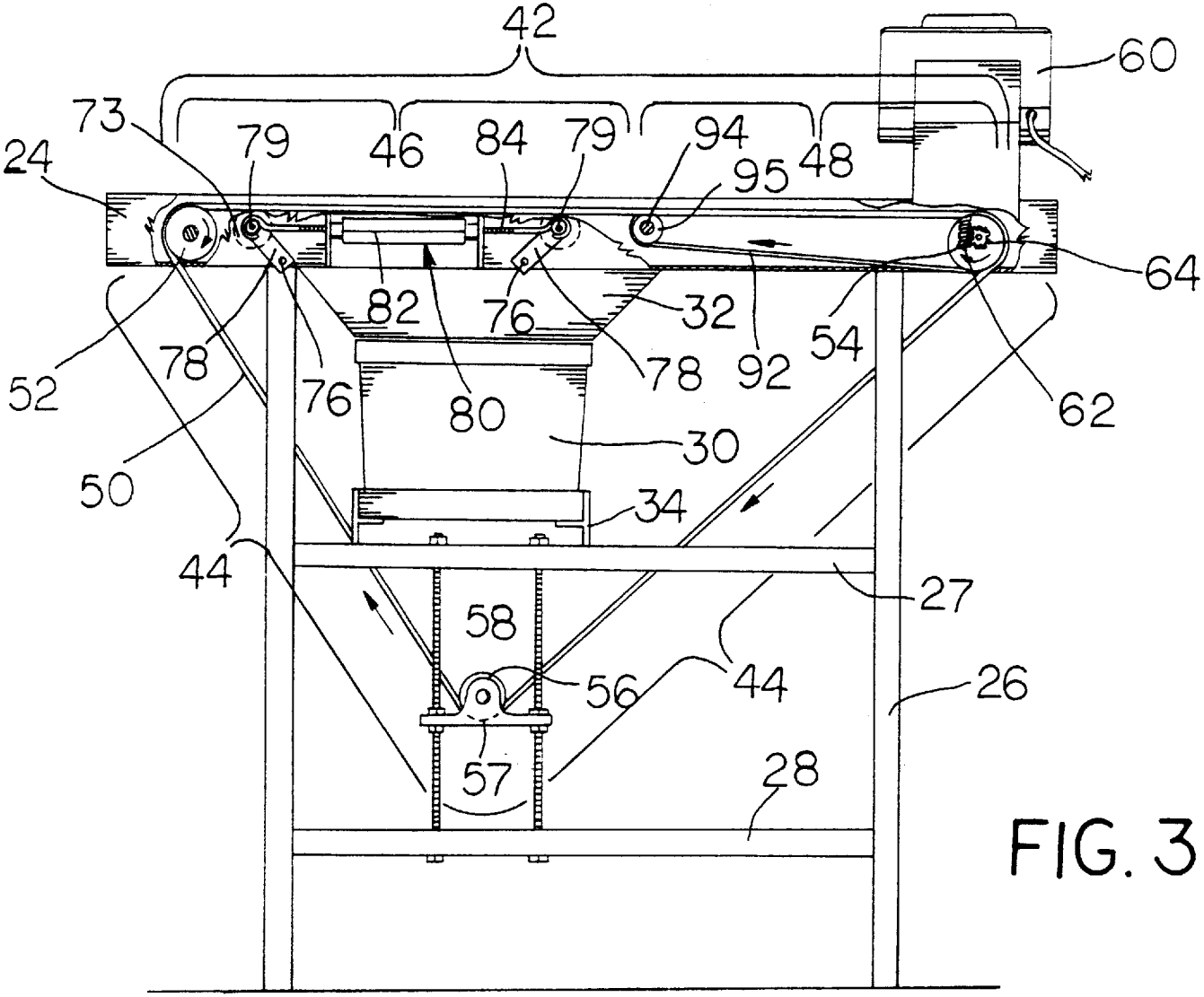
FIG. 3 is a side view of the sorting apparatus having portions of the frame cut away to show the operations of the adjustment rollers and pinch belts.

As shown in the figures, sorting apparatus 10 includes a table-like frame 20, a conventional transport conveyer assembly 40, a sorting size adjustment mechanism 70 and an anti-pinch mechanism 90. As shown in FIG. 1, frame 20 includes two elevated parallel side members 22, 24 supported by four upright legs 26. Legs 26 are connected by cross brace 25 and by upper and lower side braces 27, 28. Conveyer assembly 40 has a horizontal top run 42 and a V-shaped bottom return run 44 formed by a plurality of continuous elastic conveyer bands 50 trained about three elongated roller shafts 52, 54, 56 (see FIGS. 1–4). End roller shaft 52 and drive roller shaft 54 are rotatably mounted between side members 22, 24 at the front and rear ends of frame 20, respectively, such that top conveyer run 42 extends the entire length and covers substantially the entire width of sorting apparatus 10. Preferably, conveyer bands 50 are constructed of suitable elastic material, such as a synthetic rubber. The ends of each conveyer band 50 are joined to form a continuous band. Tension roller shaft 56 is rotatably mounted between two journal boxes 57. Each journal box 57 is adjustably mounted between side braces 27, 28 on two parallel screw shafts 58, which extend vertically between the side supports for adjustable vertical movement to adjust the tension of conveyer bands 50. A conveyer drive motor 60 is mounted near the rear end of side members 24. Motor 60 is operatively connected to drive roller shaft 54 by a screw shaft 62 and worm gear 64. Operation of motor 60 rotates drive roller shaft 54 to transfer motion to conveyer bands 50. As shown in FIGS. 1 and 2, roller shafts 52, 54, 56 each have a plurality of parallel annular grooves 51 in which conveyer bands 50 are seated (shown in FIG. 1 for tension roller shaft 56 only). Grooves 51 are uniformly spaced at fixed distances along the length of roller shafts 52, 54, 56 and ensure that conveyer bands 50 remain trained about the roller shafts with fixed horizontal spacing. Frame 20 also includes collection shields 32 for funneling produce into a removable collection hopper 30 and cross rails 34 for supporting hopper 30. Collection guides 32 are mounted to the bottom of side members 22, 24 underneath top conveyer run 42. Collection hopper 30 is seated on to cross rails 34 mounted between the upper side brace 27. Alternatively, a second conveyer (not shown) can be mounted between top conveyer run 42 and return run 44 in place of collection hopper 30.

Figure 4:
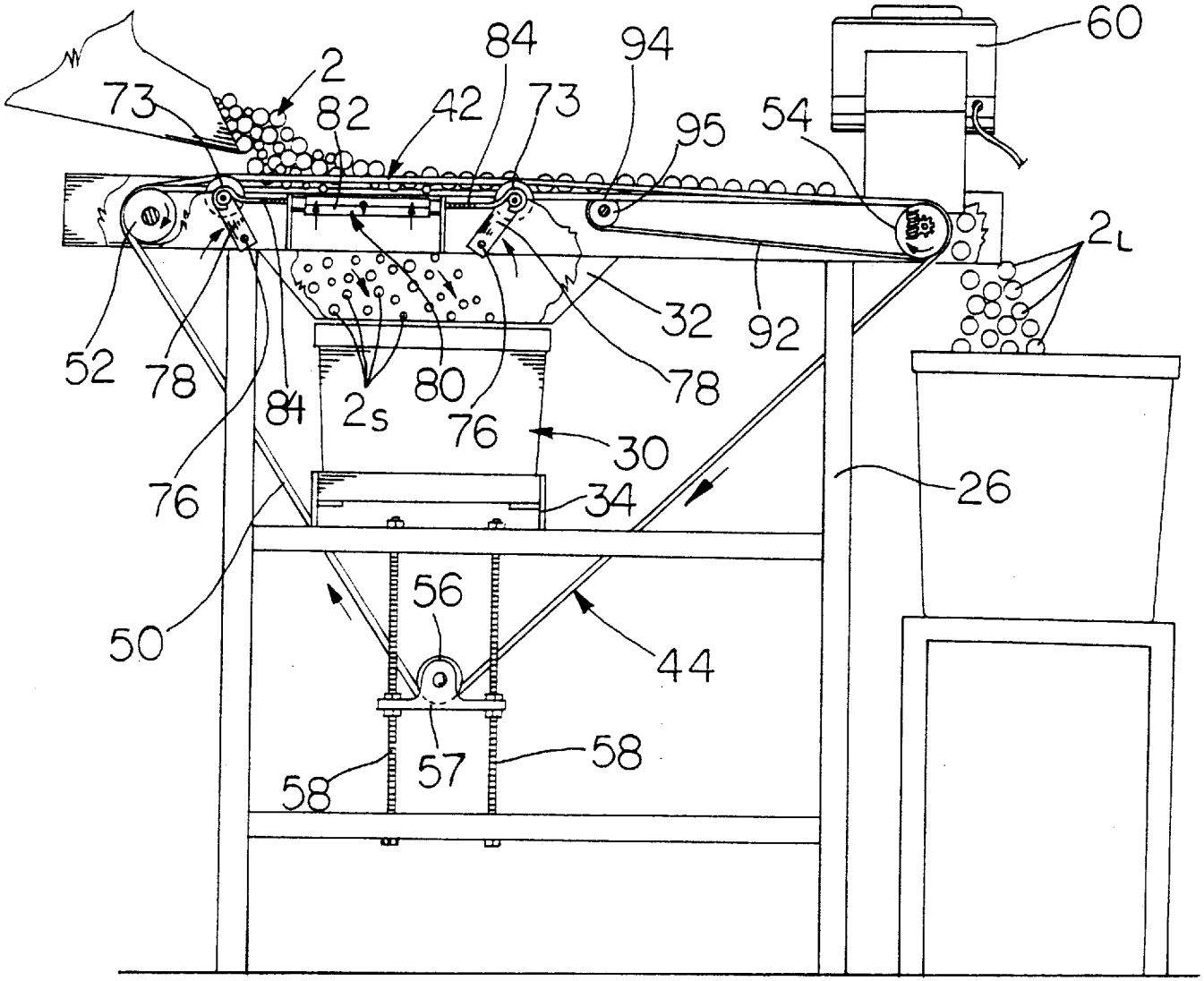
FIG. 4 is a side view of the sorting apparatus in operation sorting berries having portions of the frame cut away to show the operations of the sorting size adjustment mechanism and the anti-pinch mechanism rollers.

FIG. 4 illustrates the operation of apparatus 10. Produce 2 is deposited manually from a hopper or conveyer 4 onto top conveyer run 42 near the front of apparatus 10. As produce 2 is propelled over the sorting portion 46 of top conveyer run 42, produce $\mathbf{2}_s$ whose diameter is smaller than the spacing between adjacent conveyer bands 50 falls through top conveyer run 42 and is collected in hopper 30. The remaining produce 2, is transported to the rear of top conveyer run 42 where it is collected in a second hopper (as shown) or deposited on another conveyer or sorting apparatus (not shown).

FIGS. 1–7 show sorting size adjustment mechanism 70, which allows the spacing between adjacent conveyer bands to be varied across a sorting portion or area 46 of top conveyer run 42 without altering the horizontal spacing between the bands. As shown in FIGS. 1–4, size adjustment mechanism 70 is located near the front of sorting apparatus 10. Size adjustment mechanism 70 includes two pulley shafts 72 each mounted between a pair of articulated swing arms 74. Each pulley shaft 72 carries a plurality of pulleys 73, which are spaced to engage alternate conveyer bands 50. The swing arms allow the pulley shaft to move up and down to lift alternate conveyer bands 50. The section of top conveyer run 42 between pulley shafts 72 constitutes the sorting area 46 of the conveyer run 42. Swing arms 74 are pivotally mounted on the inside of side members 24, 26 to a pivot shaft 76. Pivot shaft 76 extends the entire width of sorting apparatus 10 and protrudes through side member 24.

Two lever arms 78 and a turnbuckle 80 connect each pair of swing arms to allow complementary movement of the pulley shafts. Lever arms 78 are connected to the protruding end of pivot shafts 76. Turnbuckle 80 oblong center body 82 internally threaded at both ends and two threaded eye hooks 84, which are turned into the ends of the center body 82. Center body 82 is supported between two vertical flanges 86, which have vertical slots 87 through which eye hooks 84 extend. Eye hooks 84 are seated on pintles 79, which extend from the distal end of each lever arm 78.

Figure 5:
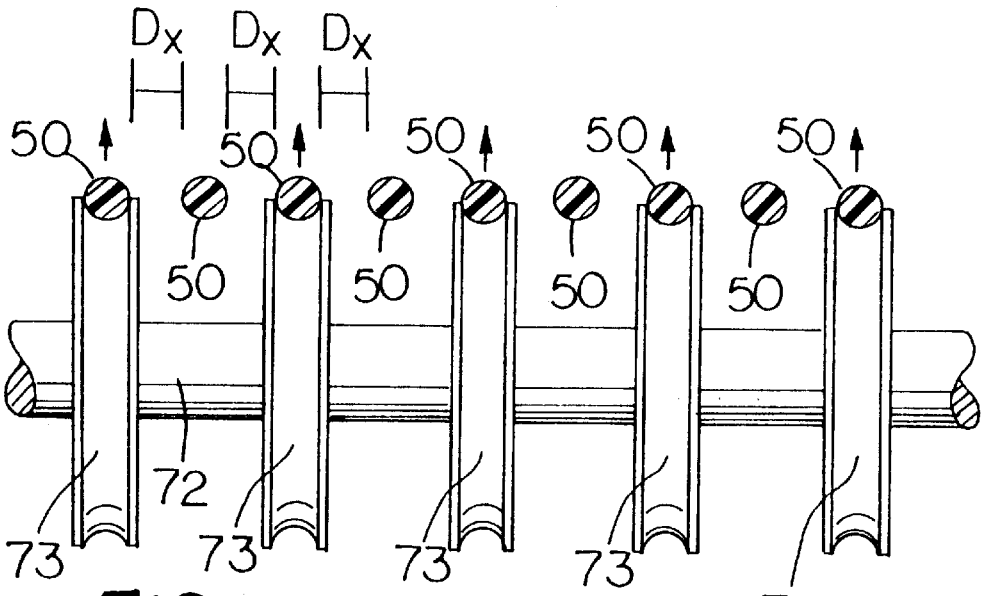
FIG. 5 is a partial front sectional view showing the adjustment pulleys and conveyer bands.
Figure 6:
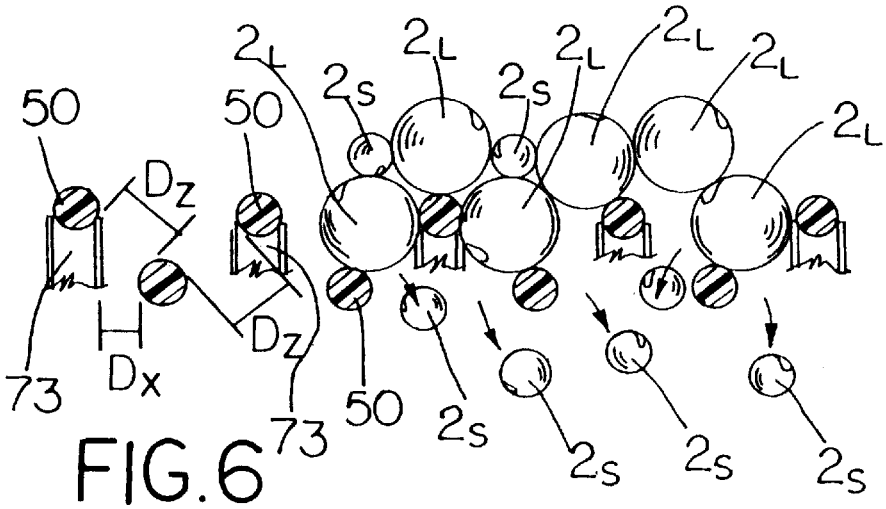
FIG. 6 is a partial front sectional view showing the diagonal spacing between the conveyer bands created by pulleys raising alternate conveyer bands.

Contracting and expanding the turnbuckle 80 pulls and pushes lever arms 78 to pivot pulley shafts 72 between their raised and lowered positions, which provides the sorting size adjustment between a minimum setting and a maximum setting. The minimum sorting size setting is achieved by expanding turnbuckle 80 so that pulley shaft 72 is in its lowered position. FIG. 5 shows the height of conveyer bands 50 across the sorting area 44 at the minimum sorting size setting, i.e., the smallest spacing between conveyer bands 50 which allows the separation of only the smallest produce. As shown, all of the conveyer bands 50 lie in the same horizontal plane along the length of top conveyer run 42. The spacing between adjacent conveyer bands is equal to the fixed horizontal distance $d_x$ between the conveyer bands. The sorting size is increased by raising alternate conveyer bands. The maximum sorting size setting is achieved by contracting turnbuckle 80 so that pulley shaft 72 is in its raised position. Raising alternate conveyer bands 50 increases the spacing between adjacent conveyer bands diagonally, while the horizontal spacing of the conveyer bands remains fixed. FIG. 6 shows the height of conveyer bands 50 across sorting area 44 at the maximum sorting size setting, i.e., the largest spacing between conveyer bands 50. As shown, alternate conveyer bands 50 are raised by pulleys 73 along the length of sorting area 44, and the spacing between adjacent conveyer bands is now the diagonal distance $d_z$ between the bands. While the relative spacing between adjacent conveyer bands 50 has increased allowing larger produce to fall through sorting section 46 of top conveyer run 42, the horizontal distance $d_x$ between adjacent conveyer bands is unchanged. Furthermore, minute adjustments to the sorting size can be made while apparatus 10 is operating by simply expanding or contracting turnbuckle 80.

Figure 7:
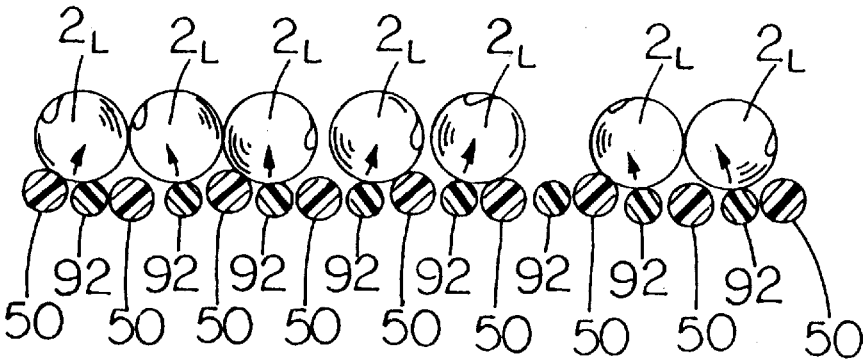
FIG. 7 is a partial front sectional showing the conveyer bands and anti-pinch bands.
Figure 8:
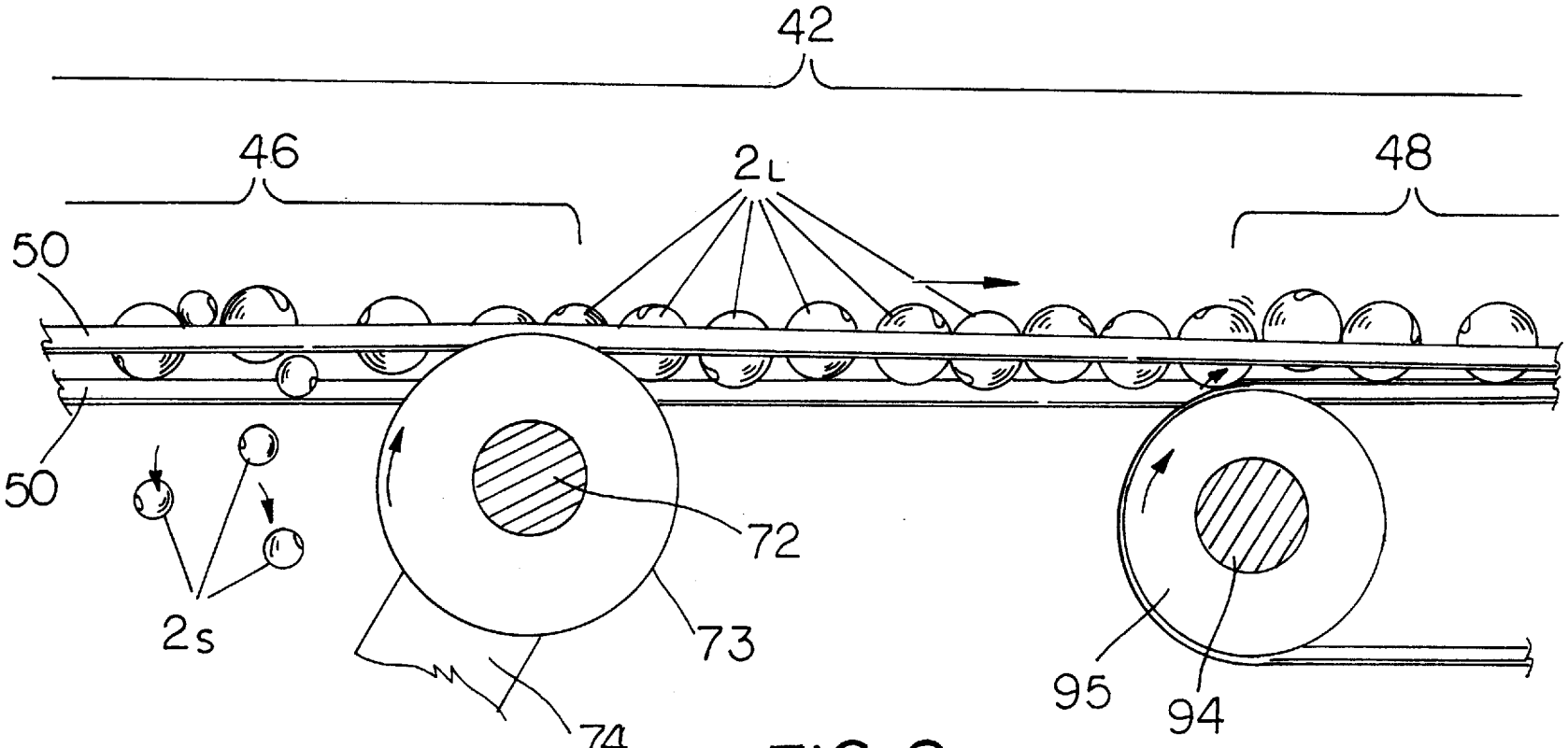
FIG. 8 is a partial side view of the adjustable size sorting apparatus of this invention showing the pinch conveyer assembly.

Anti-pinch mechanism 90 prevents produce from being pinched between adjacent conveyer bands as it travels to the end of top conveyer run 42. As shown in FIGS. 1–4, anti-pinch mechanism 90 includes a second set of parallel elastic bands 92 trained about drive roller shaft 54 and another pulley shaft 94, which acts as a fourth roller shaft. Pulley shaft 94 carries a plurality of pulleys 95 and is rotatably mounted between a pair of swing arms pivotally connected to side members 24, 26, which allows for tension adjustment of anti-pinch bands 92. As shown in FIGS. 1–4, the upper run of the anti-pinch bands 92 forms part of the top conveyer run 42, which constitutes the anti-pinch area 48 of the top conveyer run. Anti-pinch bands 92 are identical to conveyer bands 50 except that they are shorter and have a slightly smaller diameter than conveyer bands 50, generally ¼" to 5/16" respectively. Anti-pinch bands 92 prevent produce 2 from being pinched between adjacent conveyer bands 50. Since the spacing between adjacent conveyer bands 50 decreases once produce 2 passes the rear pulley shaft 72, the produce can be pinched between adjacent conveyer bands. As shown, the anti-pinch area 48 of top conveyer run 42 is immediately adjacent to sorting area 44 so that produce passes from the sorting area directly onto anti-pinch area 48. As produce 2 moves past the rear pulley shaft 72 and the spacing between adjacent conveyer bands 50 begins to decrease, the produce carried between adjacent conveyer bands 50 is pushed upward by anti-pinch bands 92 to prevent produce 2 from being damaged by the converging conveyer bands. Over the rear portion of the top conveyer run 42, produce 2 rides atop adjacent conveyer bands 50 and anti-pinch bands 92. As shown in FIG. 2 and 7, the horizontal spacing between the adjacent conveyer and anti-pinch bands is relatively insignificant in comparison to the diameter of produce 2 and therefore produce rides atop to the end of the apparatus without being damaged by the converging conveyer bands 50.

It is understood that the above description does not limit the invention to the details given, but may be modified within the scope of the following claims.

I claim:

1. An improved apparatus for sorting round produce by diameter size comprising:

a frame, conveyer means supported by said frame for sorting said produce deposited thereupon, said conveyer means formed by first and second roller shafts, a plurality of elastic conveyer bands trained about said first and second roller shafts and spaced across the width of said first and second roller shafts to form a horizontal top conveyer run and bottom return conveyer run, and drive means for propelling said conveyer bands about said first and second roller shafts, said conveyer bands being spaced at a fixed horizontal distance from each other across the width of said first and second roller shafts such that produce deposited upon said top conveyer run and having a diameter less than spacing between adjacent conveyer bands falls through said top run and produce deposited upon said top run and having a diameter greater than spacing between adjacent conveyer bands is transported to the end of said top run atop any two adjacent conveyer bands, thereby sorting said produce by size, and sorting size adjustment means positioned between said first and second roller shafts for raising and lowering alternate conveyer bands to adjust the relative spacing between adjacent conveyer bands along a portion of said top run without changing the horizontal distance between adjacent conveyer bands.

2. The apparatus of claim 1 wherein said sorting size adjustment means includes engagement means positioned between said first and second roller shafts under said top conveyer run for engaging only alternate conveyer bands, and lever means supporting said engagement means for selectively moving said engagement means between a first position where said alternate conveyer bands lie in the same horizontal plane as said other conveyer bands along the length of said top conveyer run and a second position where said alternate conveyer bands are elevated to a horizontal plane above the horizontal plane of said other conveyer bands along a portion of said top conveyer run.

3. The apparatus of claim 2 wherein said engaging means includes a pair of pulley shafts and a plurality of pulleys carried across the width of each said pulley shaft.

4. The Apparatus of claim 3 wherein said lever means includes an arm part supporting each of said pulley shafts and pivotally connected to said frame, lever parts connected to each of said arm parts and a turnbuckle connected to said lever parts.

5. The apparatus of claim 1 and anti-pinch means for preventing produce from being damaged due to said produce being pinched between adjacent conveyer bands as said produce moves away from said adjustment means along said top conveyer run.

6. The apparatus of claim 5 wherein said anti-pinch means includes a third roller shaft rotatably mounted to said frame in parallel to and between said first and second roller shaft and adjacent the rear of said adjustment means, and a second plurality of elastic bands trained about said third and second roller shafts and being interposed between said conveyer bands so that said second plurality of bands forms part of said top conveyer run.

7. The apparatus of claim 1 wherein said drive means includes a motor operatively connected to said second roller shaft to rotate said second roller shaft.

8. The apparatus of claim 1 and collection means supported by said frame and positioned below said adjustment means between said top run and said bottom return run for collecting produce which falls between said adjacent conveyer bands.

9. The apparatus of claim 8 wherein said collection means includes a hopper.

* * * * *